United States Patent [19]

Yamashita et al.

[11] Patent Number: 4,651,687

[45] Date of Patent: Mar. 24, 1987

[54] AUTOMATIC COMPRESSION RELEASING DEVICE FOR FOUR-CYCLE ENGINE

[75] Inventors: Masanobu Yamashita, Miki; Hiroshi Takada, Kako; Takemi Inoue; Suguru Yamauchi, both of Kakogawa, all of Japan

[73] Assignee: Kawasaki Jukogyo Kabushiki Kaisha, Japan

[21] Appl. No.: 811,785

[22] Filed: Dec. 20, 1985

[51] Int. Cl.[4] ..... F01L 13/08

[52] U.S. Cl. ..... 123/182; 123/90.16

[58] Field of Search ..... 123/182, 90.16, 316

[56] References Cited

U.S. PATENT DOCUMENTS

| | | | |
|---|---|---|---|
| 3,362,390 | 1/1968 | Esty | 123/182 |
| 3,381,676 | 5/1968 | Campen | 123/182 |
| 3,897,768 | 8/1975 | Thiel | 123/182 |

*Primary Examiner*—Andrew M. Dolinar

[57] ABSTRACT

An automatic compression releasing device intended for reducing the pressure inside the combustion chamber of the four cycle engine at the start by opening and closing the intake or exhaust valve of the combustion chamber actuated by the cam on the cam shaft through the tappet. A single moving piece mounted, on the side of the gear integrated with the cam shaft, as enclosing the cam shaft, can slide over the side of the gear in a given direction, guided by two slots opened in the moving piece and two pins planted on the gear side. A tappet lifting arm is extended from the moving piece to such a position as to push up the tappet. At the start, the centrifugal force on the moving piece is designed not to exceed the opposing force, thus keeping the tappet lifting arm projected out of the cam base circle, and also retaining the returning force of the moving piece acting on the tappet lifting arm through the tappet being supported by the guide slots and pins. During the normal rpm, the centrifugal force on the moving piece overcomes aforesaid opposing force to slide the moving piece along said guide slots, bringing the tappet lifting arm level with or further down into the cam base circle.

2 Claims, 11 Drawing Figures

AUTOMATIC COMPRESSION RELEASING DEVICE FOR FOUR-CYCLE ENGINE

FIELD OF THE INVENTION AND RELATED ART STATEMENT

This invention relates to an automatic compression releasing device for reducing the compression pressure of the gas mixture in a combustion chamber by automatically opening the inlet or exhaust valve slightly in starting an engine, thus leading the starting torque of the general-purpose four stroke cycle engine to be minimized for easy start.

In general, since a large force must be applied to start the general-purpose four cycle engines, especially for large-sized ones, by means of manually driving the recoil starter, reduction in the torque required for starting has been eagerly demanded lately. To comply with this requirement, the automatic compression releasing devices have been developed for practical use, which can lower the compression pressure of gas mixture inside the combustion chamber for a less starting torque by automatically opening the intake or exhaust valve slightly in starting, and to automatically release its function after the engine has come up to a preset speed of rotation.

FIG. 7 shows a typical example of the automatic compression releasing devices in accordance with the prior art, relating to the four cycle engine in which the rotation of the cam shaft 1 causes the intake or exhaust valve 5 in the combustion chamber 4 to be opened or closed by reciprocating the tappet 3 through a combination of the cam 2 on the cam shaft 1 and the valve spring 34. The automatic compression releasing device comprises an arcuate moving member 7 rotatably supported by a pin 8 approximately at its center on one half of a side face of the gear 6 integrated with the cam shaft 1 having the cam 2 actuating an either valve as described above; an arm 9 projecting sideways from one end of the inner circumference of the moving member 7 to push up the tappet 3; another arcuate moving member 10 disposed on the other half of the side face of the gear 6; one end of the member 10 rotatably supported by another pin 11 on one end of aforesaid moving member 7; the other end of the moving member 10 provided on its outer circumference with the guide 12 consisting of a plurarity of semi-circle recesses to engage with the separate pin 13 attached on the side face of the gear 6; and a spring 14 extended between one point on said other end of the moving member 10 and the other point on the moving member 7 located on the side opposite to the pin 11 relative to the pin 8.

In the start while the engine rpm is still low, the moving members 7 and 10 of the automatic compression releasing device are held in place, since the spring 14 is pulling the lower end of the moving member 7 close to the moving member 10 against its then small centrifugal force. And, since the arm 9 extended sidewards from the inner circumference of the moving member 7 then takes a position projecting out of the cam base circle 2, the arm 7 pushes up the tappet 3 in the compression stroke for every rotation of the cam shaft 1, to slightly open the valve 5, thus letting out a part of compressed gas mixture, resulting in a reduction of starting torque.

On the other hand, as the engine rpm comes up, since the moving members 7 and 10 swing outward respectively about the pins 8 and 11 due to their centrifugal forces overcoming the force of the spring 14, aforesaid arm 9 changes the position inwards of the base circle **2*a* of the cam 2, thus losing the function of pushing up the tappet 3, resulting in the valve 5 being intact in the compression stroke to have the normal closing function of the valve 5 following only the cam 2 on the cam shaft 1**.

Said type of the automatic compression releasing device according to the prior art, however, necessitates accuracy in parts dimensions and their assembly because of the presence of more than one moving members actuated by centrifugal force, and yet has a complicated structure, leading to high cost. And also the requirement of the two moving members introduces a serious drawback of large irregularities in the frictional resistances between the moving members, and the pins and the gear side faces on which said moving members slide, as well as in the viscous resistance of oil, resulting in the unstability of the preset rpm to remove the compression releasing action.

OBJECT AND SUMMARY OF THE INVENTION

It can be said that the purpose and object of this invention is to provide an automatic compression releasing device for the four cycle engine, which is simple in construction, dependable in function, easy in assembly and steady in operation, thus eliminating the drawbacks of the prior art.

To achieve this object, an automatic compression releasing device for reducing the gas pressure in the combustion chamber according to the invention, comprises a single moving member being disposed on a side of the gear integrated with the cam shaft in such a way as to surround the cam shaft; a tappet lifting arm being extended from said moving member to a position where it can push up a tappet in the compression stroke of the engine; two guide slots being bored in either said moving member or the gear, and two pins being planted in the unbored member or gear, so as to engage with said respective slots, where the engagement of said pins with said slots allows said moving member to slide independently along the side of said gear in a predetermined direction; and in the cranking stage, a centrifugal force acting on said moving member in parallel with the rotation speed being designed not to overcome a force acting on said moving member against the centrifugal force, resulting in said moving member is so retained at a position that the face of said tappet lifting arm being kept as projecting outside the base circle of the cam, and the returning force of said moving member acting on said tappet-lifting arm through said tappet is able to be sustained by the combination of said slots and said pins; said force acting on said moving member against the centrifugal force consists of the force of gravity to said moving member and a frictional force between said guide slots and said pins; and in normal speeds, the centrifugal force on said moving member induced by the rotation speed of the engine is so designed to overcome the opposite force acting on the moving member so that said moving member moves to such a position that the face of said tappet lifting arm comes down level with or inward of the cam base circle.

BRIEF DESCRIPTION OF THE DRAWING

In the accompanying drawings, there are shown illustrative embodiments of the invention from which these and other of its objectives, novel features and advantages will be readily apparent.

In the drawings.

DETAILED DESCRIPTION OF PREFERRED EMBODIMENT

Figure 1:
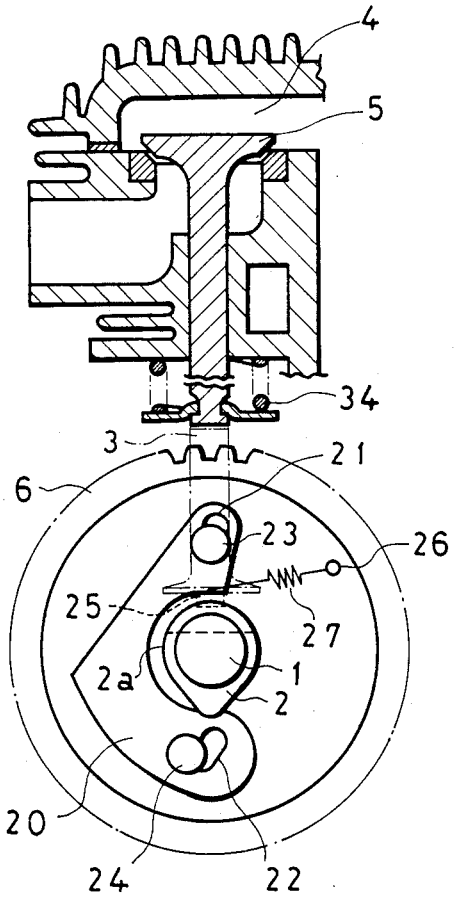
FIG. 1 is a front view of an embodiment for an automatic compression releasing device for the four cycle engine in accordance with the invention.
Figure 2:
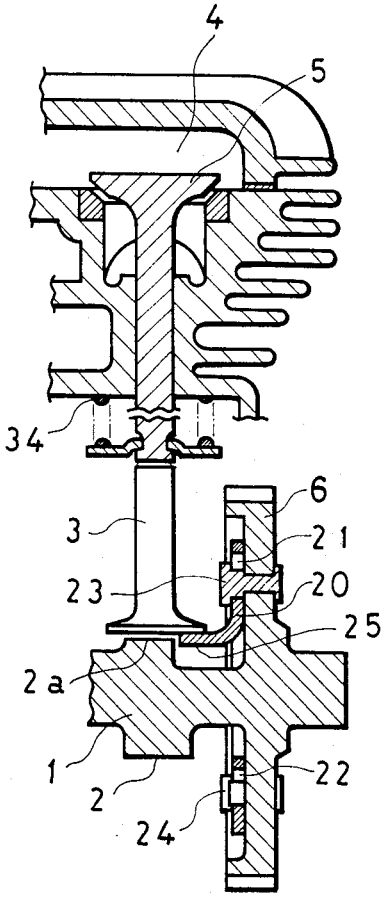
FIG. 2 is a sectional view taken along line A—A in FIG. 1.

The drawings depict in detail embodiments in accordance with the invention. FIGS. 1 and 2 illustrate an embodiment of an automatic compression releasing device for the four cycle engine according to the invention. In these drawings, Numeral 1 is a cam shaft and Numeral 2 is a cam fitted on the cam shaft 1. Numeral 3 is a tappet that opens and closes an intake or exhaust valve 5 in a combustion chamber, which is reciprocated by the cam 2 and a valve spring 34. Numeral 6 is a gear mounted on the cam shaft 1 next to the cam 2, and on the side of said gear 6 a moving member 20 is disposed surrounding about a half of the cam shaft 1. The moving member 20 is slidably supported outwards along the side of the gear 6 by pins 23 and 24 planted in the side of the gear 6 through an elliptical guide slot 21 and an L-shaped guide slot 22 which are respectively bored sideways in the opposite sides in relation to the shaft center line of the cam shaft 1. The moving member 20 has an arm 25 projecting sidewards, in order to lift the tappet 3 at least in the compression stroke. In this embodiment, a spring 27 is so extended between the tappet lifting arm 25 and a hole 26 drilled in the side of the gear 6 that said tappet lifting arm 25 is forced to project radially out of the base circle 2*a* of the cam 2 during the cranking period when the engine is being started. The base circle 2*a* of the cam 2 is partly removed in order that the cutout can accomodate the protruding tappet lifting arm 25.

In the embodiment of the automatic compression releasing device according to the invention as described above, while the engine is at rest, the moving member 20 is pulled by the spring 27 toward the hole 26, and also is helped by the engagement of the pins 23 and 24 planted in the side of the gear 6 with the guide slots 21 and 22 so that the tappet lifting arm 25 takes such a position out of the base circle of the cam as to effect the compression releasing function.

When cranking the engine at the start, the moving member 20 receives a small centrifugal force corresponding to the rotation speed of the cam shaft 1. But at this time, since the centrifugal force never exceeds the resultant force of the gravity to the moving member, a frictional force between the pin 24 and the guide slot 22, and a tension of the spring 27, the moving member 20 has no relative movement to the gear 6, thus resulting in the tappet lifting arm 25 projecting out of the base circle 2*a* of the cam 2. Therefore, in the compression stroke, the tappet is raised by the tappet lifting arm 25 while the moving member 20 being supported by the guide slot 22 and the pin 24, resulting in the valve 5 remaining open until near the top dead point of compression stroke to allow the gas mixture to escape, thus minimizing the starting torque.

Figure 3:
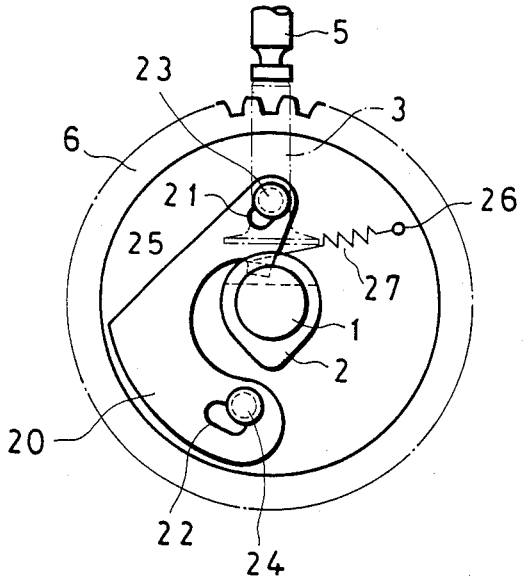
FIG. 3 is a front view of the automatic compression releasing device in FIG. 1 in the normal operating condition.

As the engine reaches the normal operating condition gathering speed, induced by the centrifugal force which has become greater than the resultant force of said gravitational force, frictional force and pull of the spring 27, the moving member 20 begins to rotate around the pin 23, thus causing the pin 24 opposite to the pin 23 to move to the edge of the bent portion in the guide slot 22. Since from this point both guide slots 22 and 21 have the same direction as shown in FIG. 3, the moving member 20 begins to slide outwards (downwards) along the side of the gear 6, thus causing the tappet lifting arm 25 receding back into the cutout on the camshaft 1 or into the inside of the base circle 2*a* of the cam 2, resulting in the loss of the function to lift the valve 5. This enables the valve 5 to remain closed over the compression stroke in accordance with the normal open-close function of the valve 5 controlled by the cam 2 on the camshaft 1.

When the engine comes to a halt, since the centrifugal force generated on the moving member 20 by the rotation of the engine disappears, the moving member 20 is pulled back in place by the pull of the spring 27 as shown in FIGS. 1 and 2 to restore the compression releasing function of the tappet lifting arm 25.

Figure 6A:
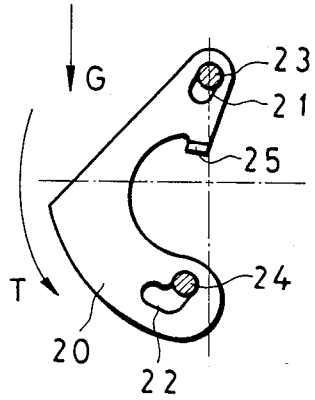
FIGS. 6*a* through 6*e* are illustrations of the operation of the embodiment shown in FIG. 1.
Figure 6B:
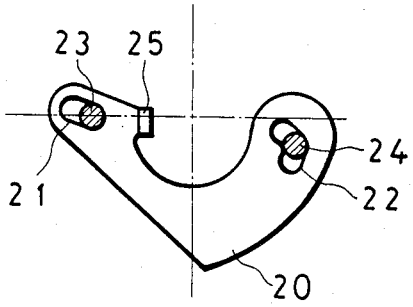
Figure 6C:
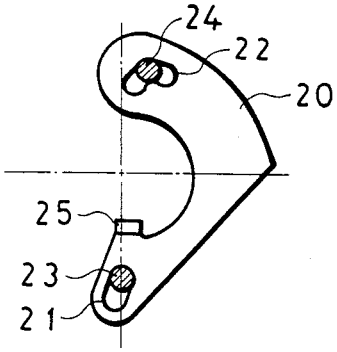
Figure 6D:
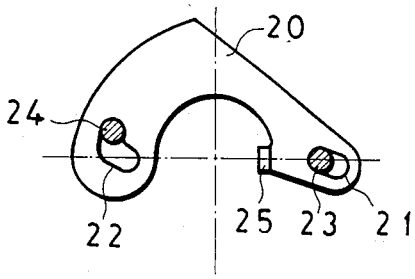
Figure 6E:
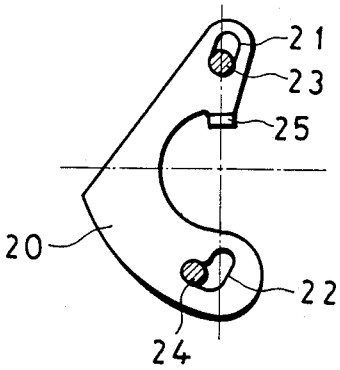
Figure 7:
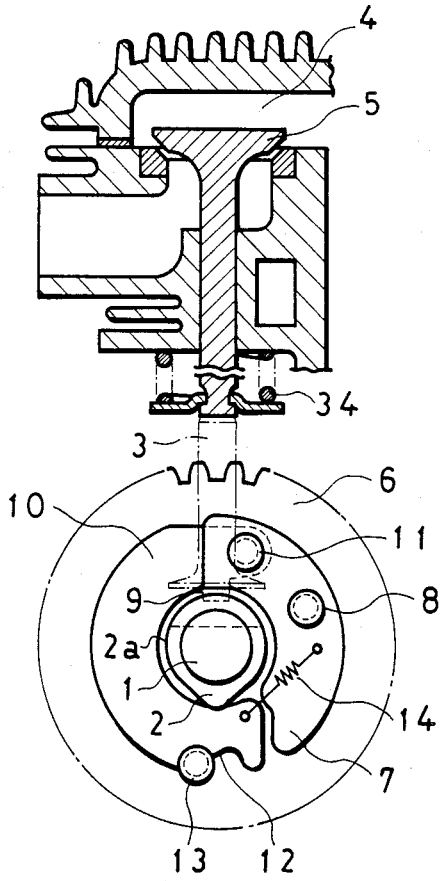
FIG. 7 PRIOR ART
FIG. 7 is a front view showing a typical type of the automatic compression releasing device for the four cycle engine in accordance with the prior art.

In this embodiment using the spring 27, the moving member 20 is so designed as to be forcibly returned in place to regain the compression releasing function by the spring 27 when the engine comes to a halt. In the case of the common horizontal engine having the camshaft 1 in the direction perpendicular to that of the gravitational force, however, without the spring 27, the moving member 20 can be returned in place to restore the compression releasing function just before pushing up the tappet 3, through the relative movement of the moving member 20 as shown in FIGS. 6*a* through 6*e*, within the last one rotation of the camshaft 1, when the engine is going to a halt, while losing the centrifugal force on the moving member. That's because, in a front view of FIG. 1, the gear 6 rotates anticlockwise, and both the slots 21 and 22 are opened diagonally from top right to bottom left. In FIG. 6*a*, Arrow G indicates the direction of the force of gravity and Arrow T the direction of the rotation of the cam gear.

Figure 4:
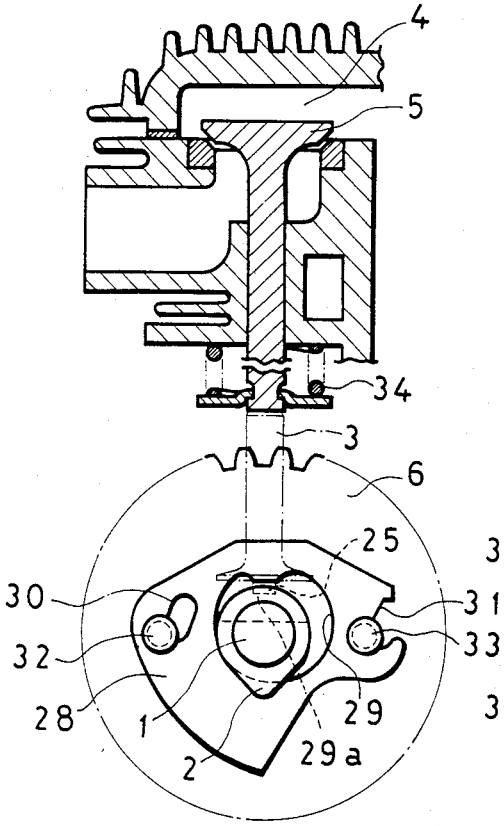
FIG. 4 is a front view of another embodiment of an automatic compression releasing device for the four cycle engine in accordance with the invention.

Next, FIG. 4 shows another embodiment in accordance with the invention in which the like reference numerals are provided for the like parts as those in aforesaid embodiment in FIG. 1, thus a further explanation being eliminated. A moving member 28 with an opening 29 resembling the human heart at the center is located on the side of the gear 6 with the opening 29 being so disposed as to surround the camshaft 1, and, from a narrow protrusion 29*a* on the opening 29, the tappet lifting arm 25 extends towards the cam 2 to push up the tappet 3 in the compression stroke of the engine. Furthermore, the moving member 28 is supported slidably on the side of the gear 6 in the direction apart from the camshaft 1, by pins 32 and 33 planted on the side of the gear 6 which engage respectively in an L-shaped guide slot 30 and an L-shaped cutout guide slot 31 situated at both opposite ends of the moving member 28 relating to the camshaft 1 on the line perpendicular to that of the up and down movement of the tappet 3.

With this embodiment of an automatic compression releasing device, when the engine is at rest, the moving member 28 occupies a position to fulfill the compression releasing function by the help of the pins 32 and 33 as well as the guide slots 30 and 31.

While the engine is running at a very low speed in the initial stage of a start, a centrifugal force in parallel with the rpm of the cam shaft 1 acts on the moving member 28, but this is not large enough to overcome the sum of the frictional resistances between the guide slot 30 and the pin 32 as well as between the guide slot 31 and the pin 33. Therefore, no movement of the moving member 28 relative to the cam gear 6 takes place, keeping the tappet lifting arm 25 projecting out of the base circle 2*a* of the cam 2, resulting in that in the compression stroke the tappet 3 is kept raised by being supported through the tappet lifting arm 25 with the guide slot 30 and the pin 32 as well as the guide slot 31 and the pin 33. Thus, the valve 5 is kept open until near the top dead point of compression stroke, letting the compressed gas mixture to escape to lower the inside pressure and minimize the start torque.

Figure 5:
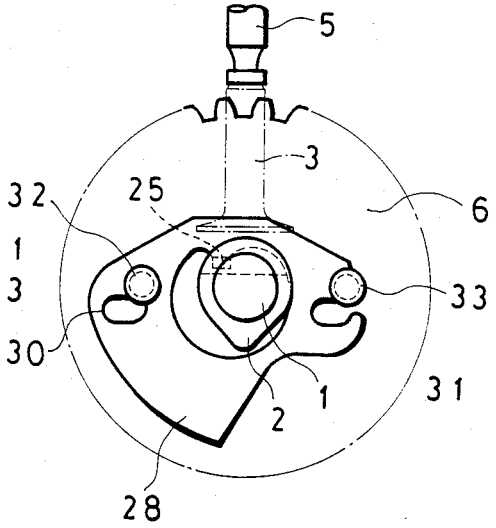
FIG. 5 is a front view of the automatic compression releasing device in FIG. 4 in the normal operating condition.

Once the engine has reached the steady operating condition after an increase of the engine rpm, since the centrifugal force acting on the moving member surpasses the combined frictional force between the guide slots 30 and 31 and the pins 32 and 33, the moving member 28, as shown in FIG. 5, slides outwards of the gear 6 along the pins 32 and 33 engaged in the guide slots 30 and 31, in the direction oblique to that of the reciprocating movement of the tappet 3, thus leading the tappet lifting arm 25 receding into the cutout in the base circle 2*a* of the cam 2. This deprives the tappet 3 of its lifting function, with the result that the valve 5 is kept completely closed over the compression stroke, so that the open-close function of the valve 5 is performed normally, following the movement of the cam 2 on the cam shaft 1.

This embodiment is applied to the horizontal type engine having the cam shaft 1 disposed in the direction perpendicular to that of the gravity. In FIG. 4, since the force of gravity acts downwards and the gear 6 revolves anticlockwise viewing from front, when the engine is nearing a halt with a minimum of the centrifugal force, the moving member 28 returns to the position where it can regain the compression releasing function right before pushing the tappet 3 up.

Though, in each of these embodiments, the pins are planted on the gear side and the guide slots opened in the moving members, the reverse is also possible, in which the guide slots are opened on the gear side and the pins are planted on the moving member.

As evident from the description given above, because the automatic compression releasing device for the 4 cycle engines according to the invention requires only a single moving member actuated by the centrifugal force due to the revolution of the cam shaft, and the return spring is not necessarily required in the general vertical type engine, the device can be easily mounted because of its exceedingly simple structure.

Since only one moving member serves to perform the compression releasing function and the tappet is directly pushed up without any additional means between them, the automatic compression releasing device can operate in an accurate fashion so as to reduce smooth the start torque and to improve remarkably the operability of the engine in the start.

In addition, an appropriate determination of the shape of the moving member and a proper design of the center of gravity can eliminate the need for the return spring with the like effect achieved.

What is claimed is:

1. An automatic compression releasing device for reducing the gas pressure in a combustion chamber of a four cycle engine for use in starting the four cycle engine in which intake and exhaust valves are opened and closed by reciprocating tappets by means of the rotation of a cam on a cam shaft through its rotation, comprising:

a single moving member being disposed on a side of a gear integrated with the cam shaft in such a way as to surround said cam shaft;

a tappet lifting arm being extended from said moving member to a position where it can push up a tappet in a compression stroke of the engine;

two guide slots being bored in said moving member, and two pins being planted in said gear, so as to engage with said respective slots, where the engagement of said pins with said slots allows said moving member to slide independently along with the side of said gear in a predetermined direction; and in the cranking stage, a centrifugal force acting on said moving member in parallel with the rotation speed being designed not to overcome a force acting on said moving member against the centrifugal force, resulting in said moving member being so retained at a position that a face of said tappet lifting arm being kept as projecting outside a base circle of the cam, and a returning force of said moving member acting on said tappet-lifting arm through said tappet being able to be sustained by the combination of said slots and said pins;

said force acting on said moving member against the centrifugal force consisting of the force of gravity to said moving member and a frictional force between said guide slots and said pins; and in normal speeds, the centrifugal force on said moving member induced by the rotation speed of the engine being so designed to overcome the opposite force acting on said moving member so that said moving member moves to such a position that the face of said tappet lifting arm comes down level with or inward of said cam base circle.

2. An automatic compression releasing device as claimed in claim 1, wherein the force acting on said moving member against said centrifugal force further including a tension force of a spring extended between said moving member and said gear.

* * * * *